US006108275A

United States Patent [19]

Hughes et al.

[11] Patent Number: 6,108,275

[45] Date of Patent: Aug. 22, 2000

[54] PHASED BEAM TRANSDUCER

[75] Inventors: W. Jack Hughes, Boalsburg; Charles W. Allen; Paul G. Bednarchik, both of State College, all of Pa.

[73] Assignee: The Penn State Research Foundation, University Park, Pa.

[21] Appl. No.: 08/991,678

[22] Filed: Dec. 16, 1997

[51] Int. Cl.[7] ..... H04R 17/00

[52] U.S. Cl. ..... 367/164; 367/103; 367/119; 310/366; 310/365

[58] Field of Search ..... 367/103, 119, 367/164; 310/365, 366, 800, 334

[56] References Cited

U.S. PATENT DOCUMENTS

| | | | |
|---|---|---|---|
| 3,905,009 | 9/1975 | Hughes et al. . | |
| 4,268,912 | 5/1981 | Congdon | 367/164 |
| 4,662,223 | 5/1987 | Riley et al. | 310/365 |

OTHER PUBLICATIONS

Huges, "Tilted directional response patterns formed by amplitude weighting and a single 90 degree shift," J. Acoust. Soc. Am., Acoustical Society of America, vol. 59 (No. 5), p. 1040–1045, (May 21, 1976).

*Primary Examiner*—Ian J. Lobo
*Attorney, Agent, or Firm*—Thomas J. Monahan

[57] ABSTRACT

A phased-beam transducer is disclosed for transmitting and receiving steered acoustic beam signals that includes a sheet of piezoelectric material such as Polyvinylidene Fluoride (PVDF), a copolymer, piezo-rubber, quartz, 1–3 PZT composite, or similar transducer material. The transducer includes specially designed electrode on each side of the piezoelectric sheet. The transducer is a two channel device with a sine channel, cosine channel and a ground lead. A summing circuit is used to sum the sine and cosine channels with a 90 ° phase shift applied by a phase shift circuit to one of the two channels, for example, the sine channel. The transducer is designed to form a predetermined steered beam at a particular frequency. If a different sound wave frequencies are used, the transducer will form useful directional beams with different steer angles and beamwidths. Variable sector coverage is achieved by forming beams at different frequencies. The cosine and sine channels can be digitized with the 90 degree phase shift and the summing done digitally.

11 Claims, 5 Drawing Sheets

PHASED BEAM TRANSDUCER

GOVERNMENT SPONSORSHIP

This invention was made with Government support under Contract No. N00039-C-92-0100 awarded by the U.S. Department of the Navy. The Government has certain rights in the invention.

BACKGROUND OF THE INVENTION

1. Field of the Invention

The present invention relates to acoustic devices, and more particularly to a phased beam transducer device for acoustic beam steering.

2. Background Art

Conventional planar sound receiver and/or transmitter devices for sonar systems use mechanically tilted transducers or electrically phased arrays to produce a steered acoustic beam. Mechanically tilting a transducer is an effective method to achieve a steered beam, but it is not practical for many underwater applications. When mounted on the hull of a ship or underwater vehicle, where the surface must be hydrodynamic, the amount the transducer can be mechanically tilted can be severely limited.

Alternatively, an array of transducers can be mounted flush with the vehicle surface and produce beams steered as far as 60°, but a different phase shift or time delay circuit is required for each element. The more the beam is steered, the closer together the elements need to be. Typically, elements are spaced a half-wavelength apart and the array is many wavelengths in dimension. Two dimensional arrays typically have the same number of elements in both planes: i.e., an eight element line array turns into a sixty-four element planar array. To form a single steered beam each element requires a phase shifter.

SUMMARY OF THE INVENTION

An object of the present invention is to provide an improved large aperture acoustic transducer device for steered acoustic beams which has only two electrical channels and one 90 degree phase shift circuit.

Another object of the present invention is to provide a lower cost improved acoustic transducer device to provide an angular sound signal that is at a predetermined angle away from the normal of the transducer device, and to eliminate the numerous phased or time delayed channels which are needed in a standard array.

A further object of the present invention is to provide an improved acoustic transducer device that forms narrow transducer beams from a cylindrical, or other non-planar surface, equivalent to beams produced by a planar array of transducer elements.

Other and further features, advantages and benefits of the invention will become apparent in the following description taken in conjunction with the following drawings. It is to be understood that the foregoing general description and the following detailed description are exemplary and explanatory but are not to be restrictive of the invention. The accompanying drawings which are incorporated in and constitute a part of this invention and, together with the description, serve to explain the principles of the invention in general terms. Like numerals refer to like parts throughout the disclosure.

DESCRIPTION OF THE INVENTION

Figure 1:
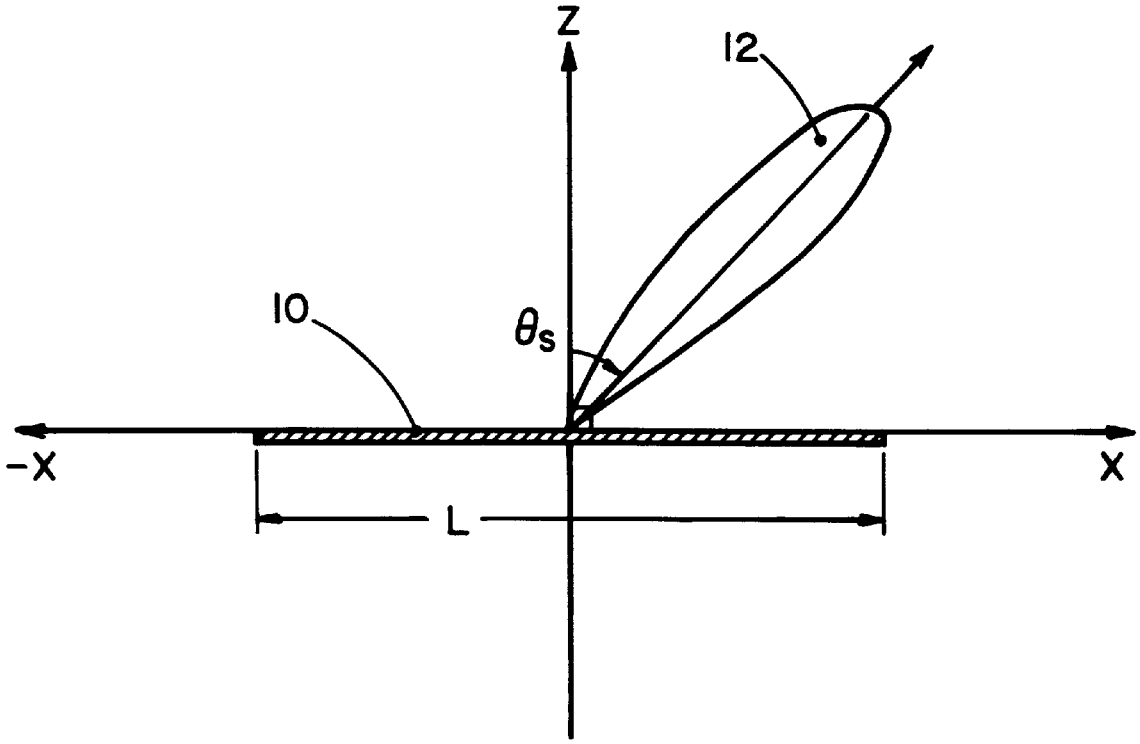
FIG. 1 is a schematic illustration of a steered acoustic beam disposed at an angle to an acoustic transducer according to the principles of the present invention.

Referring to FIG. 1, an example of an acoustic transducer device 10, and a steered acoustic beam 12 disposed at predetermined angles from the normal (z axis) of the transducer device. Acoustic transducer device 10 may be a transmitter or receiver.

Acoustic transducer device 10 may be used as a planar sound receiver and/or transmitter for sonar systems that require beams steered at pre-determined angles. The transducer 10 can also be designed to form narrow transducer beams, equivalent to an array of planar transducers when mounted on the side of a cylindrically shaped body and narrow beamwidths are desired.

Figure 2:
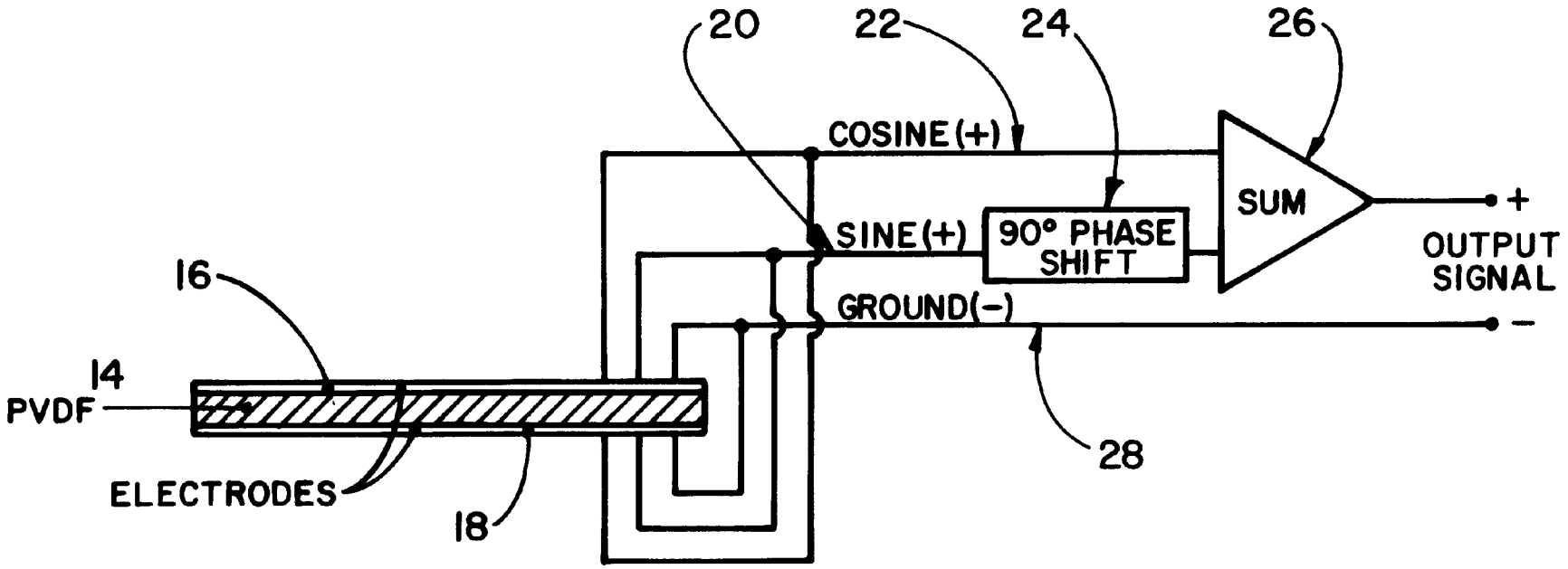
FIG. 2 is a schematic cross-sectional illustration of an embodiment of a phased-beam acoustic transducer according to the principles of the present invention.
Figures 3A, 3B, 3C, 3D, 3E, 3F, 4A, 4B, 4C, 4D, 4E, 4F:
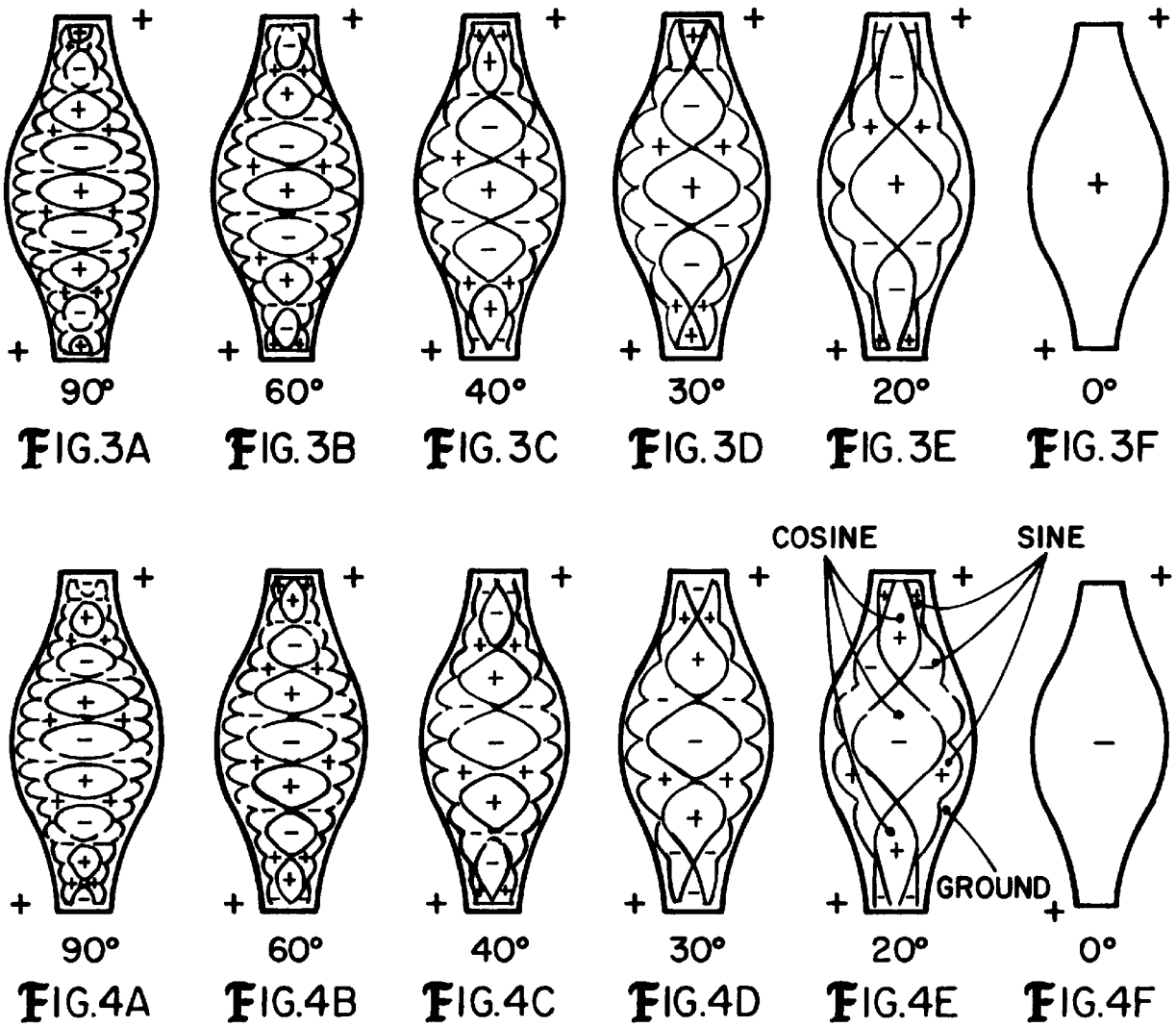
FIGS. 3A, 3B, 3C, 3D, 3E and 3F are schematic illustrations of the top electrodes of an acoustic transducer for producing steered beams at angles of 90°, 60°, 40°, 30°, 20° and 0° respectively.
FIGS. 4A, 4B, 4C, 4D, 4E and 4F are schematic illustrations of the bottom electrodes of an acoustic transducer for producing steered beam angles of 90°, 60°, 40°, 30°, 20° and 0° respectively.

The phased-beam transducer device 10, which is shown in more detail in FIG. 2 can be flush mounted with the baffle surface of a vehicle, can steer just as far as an array of individual transducers, and only requires two channels and one 90° phase shift electronic circuit. For two dimensional arrays a column of elements can be replaced by a single phased-beam transducer of the present invention.

In many applications, side-looking acoustic transducers need to be large in area and be mounted on cylindrical surfaces (underwater vehicles for example). However, when the aperture has a curvature, such as a cylindrical shell, the directivity pattern becomes broader. In order to form a narrower beam, the array of elements along the curvature are electronically phased to a plane. As in the beam steering case, this requires phase shift or time delay electronics for each of the numerous elements. The phased-beam transducer of the present invention can be used in place of the cylindrical multi-element array and only requires two channels and one 90° phase shift circuit.

Referring to FIG. 2, the phased-beam transducer 10 includes a sheet 14 of Polyvinylidene Flouride (PVDF) piezoelectric material. The piezoelectric material can also be a copolymer, piezo-rubber, quartz, 1–3 PZT composite, or similar materials which can be used in transducers. The transducer has specially designed electrodes 16 and 18 on each side of the PVDF sheet 14. The transducer 10 is a two channel device (sine channel 20 and cosine channel 22 plus a ground lead 28) that includes summing circuit 26 to sum the sine and cosine channels with a 90° phase shift applied by phase shift circuit 24 to one of the two channels, for example, sine channel 20 as shown in FIG. 2. The transducer is designed to form a predetermined steered beam at a particular frequency. However, if a different sound wave frequency is used the transducer will still form useful directional beams, only with different steer angles and beamwidths. Variable sector coverage can be achieved in this way by forming beams at different frequencies. The cosine and sine channels can be digitized with the 90 degree phase shift and the summing done digitally, such as by the use of a Hilbert transform. One skilled in the art knows that the output signals of a phased beam transducer may be coupled to a display device to show an image of the received acoustic signal. With the beam transducer of the present invention a transmit pulse can be swept through different frequencies and a two-dimensional image can be formed in a display device by taking a Fast Fourier Transfer of the received signal.

The present invention operates by spatially forming sine and cosine shape functions that are dependent on the beam steer angle and the frequency of operation. The equations for the electrode shapes of transducer 10 are given below:

$F_c(x)=A_o \cos(kx \sin \phi_s)$ and, $F_s(x)=A_o \sin(kx \sin \phi_s)$ where $A_o$=amplitude weighting, k=acoustic wavenumber ($2\pi/\lambda$) (1/meters), $\lambda$=acoustic wavelength (meters), x=distance along the transducer (meters), and $\phi_s$=beam steer angle (degrees).

Referring to FIGS. 4A, 4B, 4C, 4D, 4E and 4F, the configuration of the top electrodes 16 for the transducer 10 are schematically illustrated for steer angles 90, 60, 40, 30, 20 and 0 degrees respectively.

FIGS. 3A, 3B, 3C, 3D, 3E and 3F illustrate the configuration of the bottom electrodes 18 of transducer 10 for steer angles 90, 60, 40, 30, 20 and 0 degrees respectively.

In the particular application described, the cosine function is located in the middle of the pattern and the sine function is formed around the cosine function. Each lobe of the sine and cosine functions alternate their polarity (the sine function is asymmetric and the cosine function is symmetric), so the spatial lobes for each function alternate polarity by being connected to either the positive lead or the negative lead (see FIGS. 3A, 3B, 3C, 3D, 3E and 3F and FIGS. 4A, 4B, 4C, 4D, 4E and 4F). The sine and cosine functions can be spatially shaped in a manner to reduce the level of the secondary lobes (sidelobes)of the directivity pattern relative to the main lobe.

In FIG. 2, the leads for the positive sine lobes are brought to the outer surface of the electrodes 16 and 18 utilizing copper plated through holes and are connected in parallel. The cosine lobes are connected in the same manner. The negative lobes are all connected together on the inner side of the electrodes and are then brought through to the top of the electrodes via a plated through hole. The sine, cosine, and ground leads from one electrode are then connected to the corresponding leads from the other electrode at the sine channel lead 20, cosine channel lead 22 as shown in FIG. 2. For use as a receiver, the signal from the sine lead 20 is shifted 90° in phase by phase shift circuit 24 and then added to the signal on cosine lead 22. For use as a transmitter, the input signal to the sine lead 20 is shifted 90° in phase relative to the cosine input signal on lead 22. If phase shift circuit 24 were connected in the cosine lead 24, the cosine signal on lead 22 is shifted 90° with respect to the sine signal on lead 20 and the output, the beam would be steered in the opposite direction.

Figure 5:
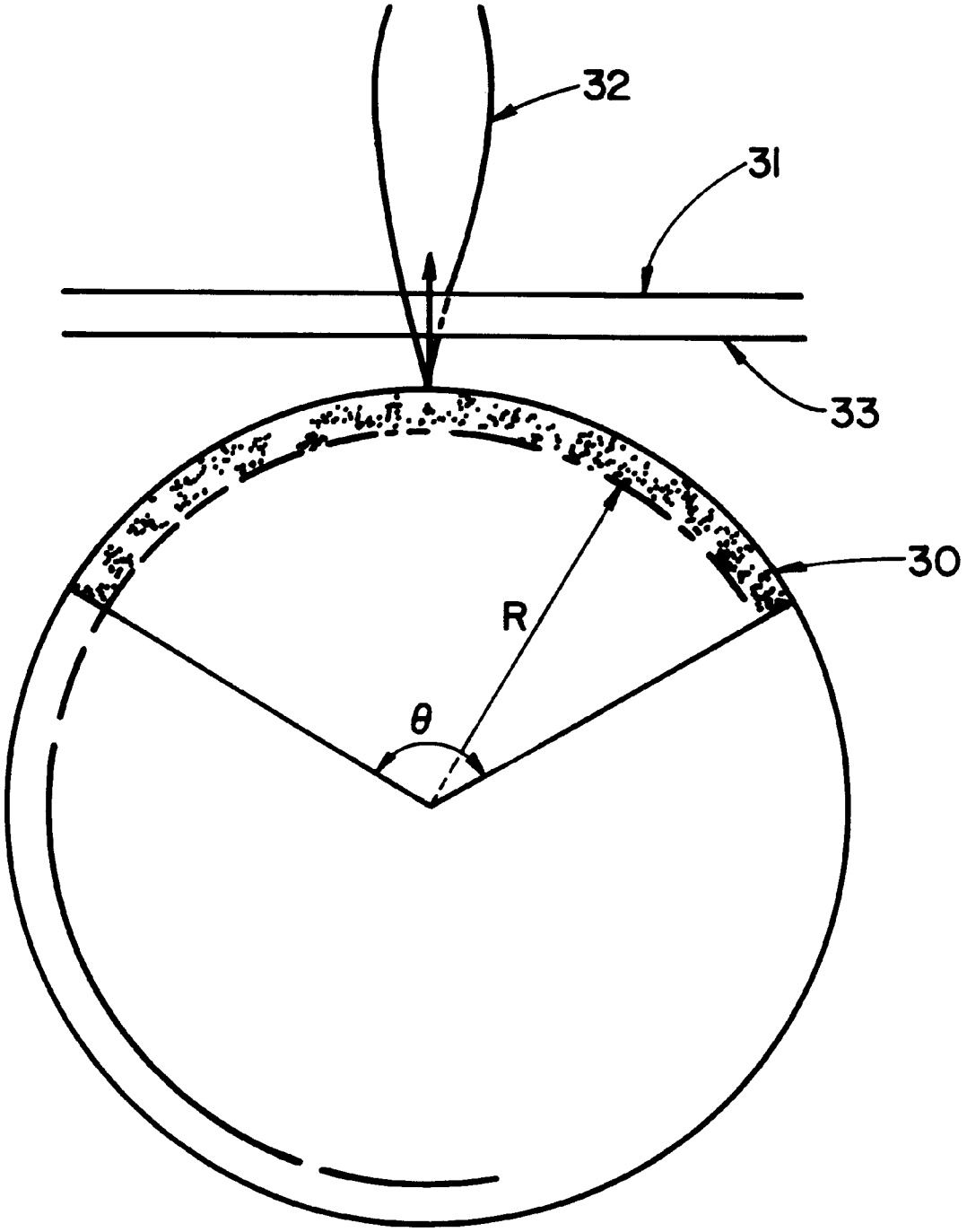
FIG. 5 is a schematic illustration of a cylindrical transducer array with phased elements for producing a narrow beam.

FIG. 5 shows an example of a cylindrical transducer array 30 having phased elements that produces a narrow acoustic beam 32. The cylindrical transducer array 30 is similar to the plane transducer array of FIG. 2 including sheet 14 and electrodes 16 and 18. The electrode pattern of transducer 30 is slightly different and based on the equation set forth below. The lines 31 and 33 in FIG. 5 represent an acoustic plane wave traveling away from transducer array 30. Typically a cylindrical transducer will produce a cylindrical wave that will cause the sound energy to spread out over a wider angular area than the planar wave produced by the cylindrical transducer of FIG. 5 of the present invention.

Figure 6:
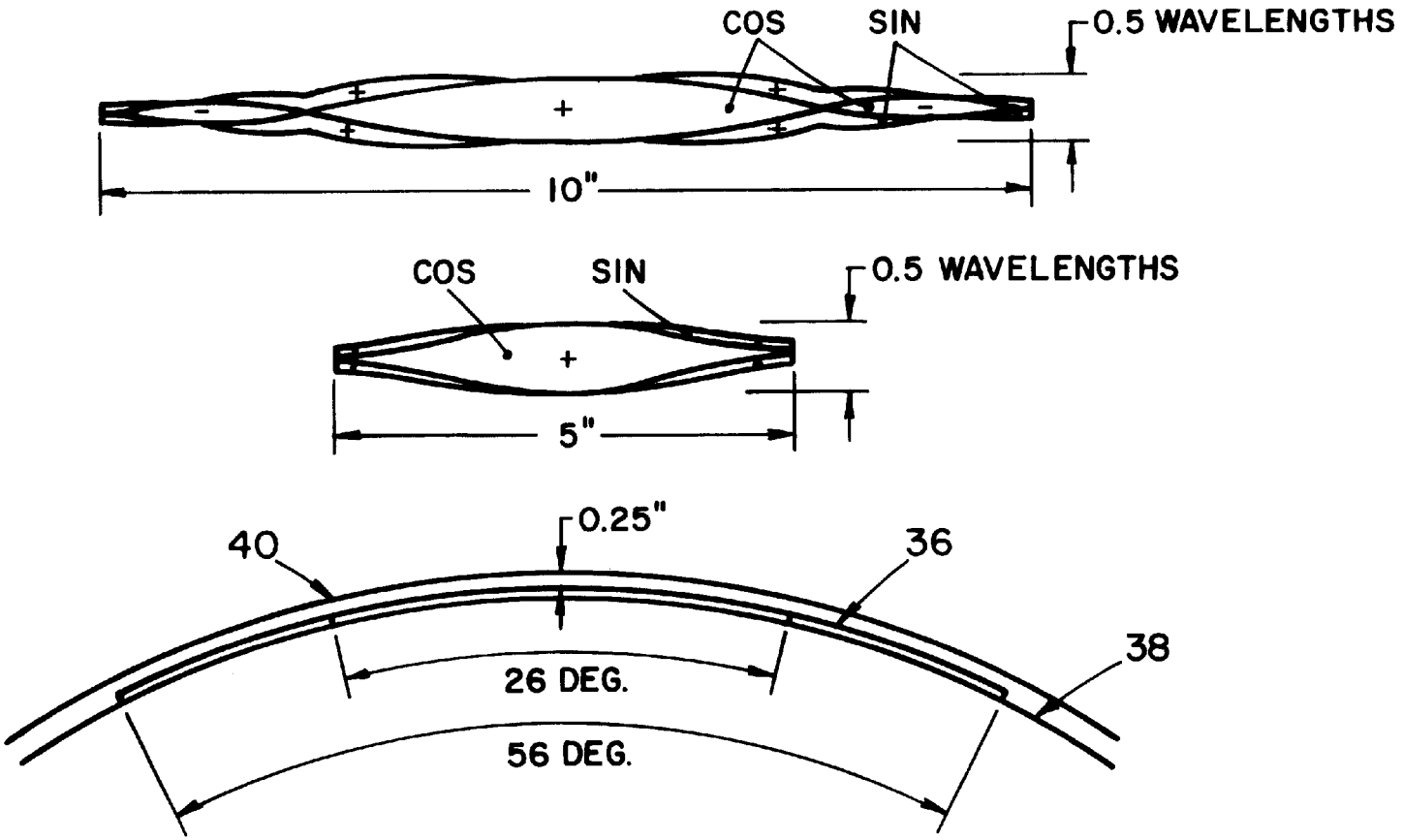
FIG. 6 is a schematic illustration of a cross-section of phased-beam transducer on a cylindrical surface for producing narrow beams by phasing to a plane.

FIG. 6 illustrates an example of a phased-beam acoustic transducer 36 on a cylindrical surface 38 and covered by a polyurethane window 40 that produces narrow beams by phasing to a plane. Transducer 36 is similar to the transducer of FIG. 2 (sheet 14 and electrodes 16 and 18) but the electrode pattern is different and is based on the equations below.

A narrow beam from a cylindrically shaped transducer 30 as shown in FIG. 5 is formed by making the sine function symmetric instead of asymmetric as shown in FIG. 6 and by making the sine and cosine functions dependent on the cosine of the arc angle instead of the linear dimension (x). The equations for the electrode shapes in FIG. 6 are:

$F_c(\theta)=A_o \cos(kR(1-\cos\theta))$ and $F_s(\theta)=A_o \sin(kR(1-\cos\theta))$, where: R=radius of cylinder (meters), and $\theta$=arc angle (degrees).

FIG. 6 illustrates a "conformal array vertical stave" which means that each transducer in FIG. 6 would form a single column of a line array of transducers that lie along the horizontal axis of the cylinder surface 38. The vertical direction is defined as the circumferential direction of the cylinder surface. The present invention can be used as a single vertical stave or an array of vertical staves. In FIG. 6, the conformal array of shaped elements may be "phased to plane", meaning that the acoustic wave in the vertical direction is phased or shifted in time at specific locations along the vertical direction to provide a planar wave instead of a cylindrical wave.

This is unique because conventional arrays of many transducers in the vertical direction phase shift the signal going to each transducer to produce a planar wave.

What has been described is an acoustic transducer that functions as a receiver and/or transmitter that is maximized to provide an angular sound response in a small angular area in a particular direction that is a predetermined angle away from the normal of the device. The transducer can be used as a planar sound receiver and/or transmitter for sonar systems that require beams steered at pre-determined angles. The transducer can also be embodied to form narrow transducer beams equivalent to an array of transducer elements that conforms to a cylindrical surface and where the elements have been phased to a plane for use on underwater vehicles where the transducer may have been mounted on the side of a cylindrical shaped body and narrow beamwidths are desired.

While the invention has been described in connection with a preferred embodiment, it is not intended to limit the scope of the invention to the particular form set forth, but, on the contrary, it is intended to cover such alternatives, modifications, and equivalence as may be included within the spirit and scope of the invention as defined in the appended claims.

What is claimed is:

1. A phased beam transducer for transmitting and receiving steered acoustic beam signals comprising:

a sheet of piezoelectric material having first and second sides, a first electrode means having a first configured electrode element disposed on said first side of said sheet of piezoelectric material for transmitting and receiving acoustic beam signals, a second electrode means having a second configured electrode element disposed on said second side of said sheet of piezoelectric material for transmitting and receiving acoustic beam signals, wherein said first and second configured electrode elements on the first and second sides of said sheet of piezoelectric material are disposed in patterns of spatially shaped electrode material to form sine and cosine shape functions dependent on an acoustic beam steer angle signal frequency, a cosine lead, a sine lead and a ground lead connected to said first configured electrode on said first side of said sheet of piezoelectric material and to said second configured electrode on said second side of said sheet of piezoelectric material, a phase shift circuit means connected to a selected first one of said sine and cosine leads, and a summing circuit means connected to the other one of said sine and cosine leads and to the output of said phase shift circuit means to provide a steered beam accoustic output signal in selected directions at selected frequencies.

2. A phased beam transducer according to claim 1 wherein said patterns of spatially shaped electrode materials are formed into sine function lobes and cosine function lobes wherein each lobe of sine and cosine functions have alternate positive and negative polarity.

3. A phased beam transducer according to claim 1 wherein the shaped electrode material for the cosine shape function is disposed on said electrode means in the middle of said pattern and said shaped electrode material for the sine shape function is disposed around said electrode material for the cosine shape function.

4. A phased beam transducer according to claim 1 wherein the said cosine electrode shapes are represented by the expression:

$F_c(x)=A_o \cos(kx \sin \theta_s)$ and said sine electrode shapes are represented by the expression $F_s(x)=A_o \sin(kx \sin \theta_s)$ where $A_o$=amplitude weighting, k=acoustic wavenumber $(2\pi/\lambda)$ (1/meters), $\lambda$=acoustic wavelength (meters), X=distance along the transducer (meters), and $\theta_s$=beam steer angle (degrees).

5. A phased beam transducer according to claim 1 wherein said phase shift circuit means provides a ninety degree phase shift.

6. A phased beam transducer according to claim 1 wherein said phase shift circuit means is connected to said acoustic beam signals on said sine lead and said summing circuit means is connected to said phase shift circuit means and to said acoustic beam signals on said cosine lead to provide steered beam acoustic output signals in a first direction.

7. A phased beam transducer according to claim 1 wherein said phase shift circuit means is connected to said cosine lead and said summing circuit is connected to said phase shift circuit means and to said sine lead to provide steered beam acoustic output signals in a second direction.

8. A phased beam transducer according to claim 6 wherein the phase shifted signal on said sine lead is summed out of phase with the signal on said cosine lead to provide the steered beam acoustic output signals in a second direction.

9. A phased beam transducer according to claim 1 wherein said phased beam transducer forms a predetermined steered beam at a particular frequency to provide a signal for creating a one-dimensional image array.

10. A phased beam transducer according to claim 1 wherein said phased beam transducer forms a predetermined steered beam at different frequencies to provide a signal for creating a two-dimensional image.

11. A phased beam transducer for transmitting and receiving planar narrow acoustic beam signals comprising:

a curved element and an array of electrodes disposed on said curved element for providing symmetric sine and cosine shape electrodes, wherein the cosine electrode shapes are represented by the expression:

$F_c(\theta)-A_o \cos(kR(1-\cos \theta))$ and the sine electrode shapes are represented by the expression $F_s(\theta)=A_o \sin(kR(1\cos \theta))$, Where: R=Radius of cylinder (meters), and $\theta$=arc angle (degrees) and Where $A_o$=amplitude weighting, k=acoustic wave number $(x\pi/\lambda)$(1/meters), $\lambda$=acoustic wavelength (meters), x=distance along the transducer (meters), and $\theta_s$=beam steer angle (degrees).

* * * * *